US009586436B2

(12) United States Patent
Evers

(10) Patent No.: US 9,586,436 B2
(45) Date of Patent: Mar. 7, 2017

(54) STRETCHER FRAME FOR A STRETCHABLE CARRIER

(71) Applicant: Frederick Anthony Evers, Amersfoort (NL)

(72) Inventor: Frederick Anthony Evers, Amersfoort (NL)

( * ) Notice: Subject to any disclaimer, the term of this patent is extended or adjusted under 35 U.S.C. 154(b) by 0 days.

(21) Appl. No.: 14/011,780

(22) Filed: Aug. 28, 2013

(65) Prior Publication Data

US 2014/0060761 A1 Mar. 6, 2014

(30) Foreign Application Priority Data

Aug. 28, 2012 (NL) ..... 2009376

(51) Int. Cl.

| | |
|---|---|
| ***E06B 9/24*** | (2006.01) |
| ***A47G 5/00*** | (2006.01) |
| ***E06B 3/30*** | (2006.01) |
| ***B44D 3/18*** | (2006.01) |

(52) U.S. Cl.

CPC ..... *B44D 3/185* (2013.01)

(58) Field of Classification Search

CPC ... B44D 3/185; E06B 9/52; E06B 3/96; E06B 3/964; E06B 3/984; E06B 3/9681

USPC ..... 160/371, 381, 378, 374.1; 38/102.1, 38/102.4, 102.5; 403/295

See application file for complete search history.

(56) References Cited

U.S. PATENT DOCUMENTS

| | | | | |
|---|---|---|---|---|
| 373,156 | A * | 11/1887 | Smyth | 160/374.1 |
| 496,223 | A | 4/1893 | Graves | |
| 2,989,788 | A * | 6/1961 | Kessler | 403/295 |
| 3,494,409 | A * | 2/1970 | Prechtl et al. | 160/374.1 |
| 3,651,854 | A * | 3/1972 | Terna | 160/374.1 |
| 3,830,278 | A * | 8/1974 | Packer | 160/378 |

(Continued)

FOREIGN PATENT DOCUMENTS

| | | | |
|---|---|---|---|
| BE | 848203 | A7 | 3/1977 |
| EP | 1995078 | A1 | 11/2008 |

(Continued)

OTHER PUBLICATIONS

Dutch Search Report and Written Opinion dated Mar. 27, 2013, as issued in corresponding Netherlands Patent Application No. 2009376, filed Aug. 28, 2012.

(Continued)

*Primary Examiner* — Katherine Mitchell

*Assistant Examiner* — Jeremy Ramsey

(74) *Attorney, Agent, or Firm* — Maier & Maier, PLLC

(57) ABSTRACT

A stretchable carrier that has been provided with four straight stretcher bars that are divided in the corners by surfaces that stretch along the bisecting line of the corner between the center line of the stretcher bars that meet in the corner and at least one key fixed in a corner that is connected with both stretcher bars meeting in the said corner by means of friction effected by being jammed between the stretcher bars, whereby the top angle of the key is aimed at the corner and whereby the angle of the key is larger than the angle enclosed by the center lines of the stretcher bars meeting in the said corner. As this key is connected to the stretcher bars by this jamming and friction, the stretcher bars can be adjusted to any required dimensions without problems when connecting the stretcher bars.

16 Claims, 4 Drawing Sheets

(56) References Cited

U.S. PATENT DOCUMENTS

| | | | | |
|---|---|---|---|---|
| 3,978,905 | A * | 9/1976 | de Lama | B44D 3/185 160/378 |
| 4,144,660 | A * | 3/1979 | Lamb | 38/102.5 |
| 5,918,392 | A * | 7/1999 | Bates | 38/102.1 |
| 6,520,240 | B2 * | 2/2003 | Sooklaris | 160/379 |
| 2002/0014316 | A1 | 2/2002 | Sooklaris | |
| 2007/0277407 | A1 | 12/2007 | Pacovsky | |

FOREIGN PATENT DOCUMENTS

| | | | |
|---|---|---|---|
| FR | 2809989 | A1 | 12/2001 |
| GB | 2 264 056 | A | 8/1993 |
| NL | 2 000659 | C | 11/2008 |
| WO | 2009062282 | A1 | 5/2009 |

OTHER PUBLICATIONS

Great Britain Search Report and Examination Opinion dated Feb. 21, 2014, and Feb. 24, 2014, respectively, in connection with corresponding GB Application No. GB1314996.8 (4 pgs.).

* cited by examiner

STRETCHER FRAME FOR A STRETCHABLE CARRIER

RELATED APPLICATIONS

This application claims priority under 35 U.S.C. §119 to Netherlands Patent Application No. 2009376, filed Aug. 28, 2012, the disclosure of which is incorporated by reference herein in its entirety.

FIELD OF THE INVENTION

The present invention concerns a stretcher frame for a stretchable carrier, whereby the stretcher frame consists of at least three elongated stretcher bars that stretch out along a straight line between corner positions, whereby the stretcher bars are divided in the corner positions by surfaces that stretch out along the bisecting line of the angle that is enclosed between the centre line of the stretcher bars that meet in the said corner and the stretcher frame includes at least one key located in a corner position that is attached to both stretcher bars meeting in the corner concerned by means of friction effected by clamping between the stretcher bars and the key, whereby the top angle of the key is aimed at the corner.

BACKGROUND OF THE INVENTION

Stretcher frames for stretching a stretchable carrier are generally known. Standard stretcher frames consist of a stretcher frame made up of key bars or stretcher bars of which the diagonal ends of the stretcher bars are provided with a connecting element and whereby the connecting element is arranged in such a way that this may be inserted in a groove in the diagonal end of the connecting stretcher bar. An often occurring problem when stretching a stretchable carrier, such as a painter's canvas, on a stretcher frame, is that during the drying of the materials applied to the carrier such as ink or paint, or over time, the tension of the carrier changes. By placing keys in the corners of the stretcher frame the key bars in the corners can be moved slightly outward in order to properly re-tension the carrier.

A disadvantage of these standard stretcher frames is that the consumer and the stretcher maker have no flexibility for producing the stretcher frames to size. After all, the dimensions of standard stretcher frames are determined during the production of the stretcher bars themselves, not when making the stretcher frame. Another disadvantage is that the stretcher bars such as those used in standard stretcher frames have a limited flexibility at the corners of the stretcher frame for re-tensioning the carrier after this has been fixed to the stretcher frame for some time.

SUMMARY OF THE INVENTION

The purpose of the present invention is to provide a stretcher frame of the above said type, whereby the dimensions of the stretcher frame may be determined by the stretcher maker and whereby the stretcher bars have a greater degree of flexibility for re-tensioning the carrier after it has been fixed to the stretcher frame.

For this purpose, the invention provides for a stretcher frame of the type indicated in the introduction whereby the key has a top angle that is larger than the angle that is enclosed by the centre lines of the stretcher bars that meet in the corner position concerned.

By using such a key that is connected to both stretcher bars meeting in the said concern position by means of friction between the key and the stretcher bars, the possibility is created to adapt the stretcher bars to any required dimension without this causing a problem for the connection between the two stretcher bars. The key of the present invention thereby functions as the connecting element. The stretcher frames of the present invention may be adapted to any required dimension by means of sawing off the profile material of the stretcher bars. The possibilities of the stretcher maker are thus only limited in first instance by the initial length of the stretcher bars.

Apart from that the use of a key with a top angle aimed at the corner, whereby the top angle is larger than the angle of the corner that is created by the stretcher bars meeting in that corner, creates the possibility to change the angle between the stretcher bars so as to correct the tension of the carrier. This increases the flexibility of the stretcher frame because the stretcher bars meeting in the corner are no longer directly connected, but only indirectly by means of the key of the present invention.

The stretcher frame of the present invention can be given any required shape. For example, the stretcher frame may be given the shape of a triangle, a square, a rectangle, a pentagon, a hexagon, etc. Apart from stretcher frames that have straight sides it is also possible to create stretcher frames of which the stretcher bars do not have mainly straight sides. According to the preferred execution the stretcher frame of the present invention has a rectangular shape and this rectangular shape is formed by four stretcher bars and at least one of the keys has an obtuse angle.

Preferably each of the corner positions of the stretcher frame is provided with such a key. After all, this makes it possible for each of the stretcher bars to be 'wedged outward'. In many cases the carrier will only expand in one direction so that only two facing stretcher bars have to be moved. Even then it would be desirable for each of the corners to be provided with a key. It is also possible to provide part of the keys with a top angle that corresponds with the corner between the stretcher bars. It may however be feasible that only part of the number of corner positions is provided with keys according to the invention and that in the other corner positions the stretcher bars are joined with an adhesive. Thereby the keys may be used to provide the stretcher bars with sufficient bonding surface for the adhesive joint.

The key of the present invention is connected to both stretcher bars that meet in the corner position of the stretcher frame concerned by means of friction effected by the clamping of the stretcher bars, whereby preferably the stretcher frame is provided with an inside groove on the inside of the stretcher bar and at least one key fits jammed into the inside groove of the stretcher bar. It would also be possible to provide the key with grooves and the stretcher bars clamp into the grooves of the key.

To obtain a sufficiently large clamping surface, it would be preferred that the depth of the inside groove is at least twice as large as the width of the inside groove.

The stretcher bars for the present invention may be produced from various materials. Such materials may be chosen from synthetic materials, metals such as aluminium, wood products and combinations thereof. Preferably it concerns stretcher bars consisting of materials that may be shortened to any required length by the stretcher maker. The first preference would be that the stretcher bars be produced from wood products such as plywood or MDF. These materials further have the advantage that they provide good friction.

Just like the stretcher bars the keys may be produced from various materials. Such materials may be chosen from synthetic materials, metals such as aluminium, wood products and combinations thereof. Preferably the keys would be produced from wood products such as plywood or MDF. Here too, wood products have the advantage of a low price and good friction, which is important when clamping the keys between the stretcher bars.

In another variant the stretcher frame is provided with an external groove on the outside edge and at least one corner piece has been clamped in the outside groove of the stretcher bars that meet in a corner position. The corner piece of the present invention preferably has an angle that is more or less equal to the angle formed by the stretcher bars that meet in the corner position. The first preference would be that the corner piece has an L-shape. A corner piece may be used in combination with the key of the present invention in the same corner position, whereby a stronger construction is achieved. It is also possible to connect the stretcher bars that meet in the corner position without making use of the key of the present invention. It is preferable that the depth of the outside groove is at least twice as large as the width of the outside groove. Furthermore, it would be visually more attractive if the corner piece does not protrude from the groove; in other words, that the corner piece is completely flush with the groove.

Furthermore, it is noted that these measures concerning the corner piece and the outside groove could also be applied independently of the key construction according to the invention.

In one variant at least one corner position is provided with a corner piece. Preferably a corner piece is provided at each of the corners of the stretcher bars.

The corner pieces may be created from various materials. Such materials may be chosen from synthetic materials, metals such as aluminium, wood products or wood-like materials and combinations thereof. The corner pieces are preferably made from wood products such as plywood and MDF.

In another variant at least one of the stretcher bars is constructed from at least two stretcher bar sections and the stretcher bar sections are provided with a groove on the inside and the outside surface of the interface joint and the stretcher bar sections are connected at the interface joint by two extension elements that run along the grooves on the inside surface and the outside surface and that have been fastened in the grooves with clamps. This enables the stretcher maker to use up remainder pieces of stretcher frame profile to reduce waste. These extension elements are preferably glued in the grooves to create a permanent joint between the stretcher bar sections.

It may be clear that these measures concerning the extension of the stretcher bars can also be applied independent from the key construction or the outside corner construction according to the invention.

The extension elements of the present invention may be created from various materials. Such materials may be chosen from synthetic materials, metals such as aluminium, wood products or wood-like materials and combinations thereof. The extension elements are preferably made from wood products such as plywood and MDF.

According to a further variant the stretcher frame has been provided with a reinforcement element that is placed between two parallel stretcher bars and perpendicular to these two stretcher bars that are thus connected by the reinforcement element, stretching into the inside groove of the parallel stretcher bars and joined to said stretcher bars by coupling pieces that are clamped in the grooves. Such reinforcement elements prevent the stretcher frame elements from warping or becoming unstable, especially in case of longer lengths. Preferably the thickness and the width of the profile of the reinforcement element generally correspond to the thickness and the width of the profile of the stretcher bars, which simplifies the logistics of the needed profiles.

Preferably the coupling elements have at least a first section that stretches into the inside groove of the parallel stretcher bars and at least a second section that stretches into a groove that has been provided on one of the surfaces of the reinforcement element. This after all provides a good joint between the stretcher bar and the reinforcement element.

According to a specific variant the coupling elements have an L-shaped configuration, whereby one leg stretches into the inside groove of the parallel stretcher bars and the other leg stretches into the groove that has been provided on one surface of the reinforcement element. This variant further has the advantage that the configuration corresponds to the construction of the four corner pieces that are used for strengthening the joint between the stretcher bars that meet in a corner. This results in a logistical simplification.

According to another preferred variant the coupling elements have a U-shaped configuration, whereby the two legs stretch out into a groove that has been provided at two sides of the reinforcement element and of which the connecting section stretches out into the inside groove of the parallel stretcher bars.

The reinforcement and the coupling elements of the present invention may be created from various materials. Such materials may be chosen from synthetic materials, metals such as aluminium, wood products or wood-like materials and combinations thereof. The reinforcement and the coupling elements are preferably made from wood products such as plywood and MDF.

These measures concerning the reinforcement elements too may be applied independently from the other measures of the invention.

One of the variants provides the stretcher bars with a raised profile on the front, bordering on the outside edge, stretching along the length of the bar. The raised profile preferably has a round configuration. Such a raised profile prevents the appearance of a disturbing length with the width of the stretcher bars to appear when treating the carrier (for example when painting the canvas). Furthermore, it would be preferable for the stretcher bars to be bevelled from front to back on their outside surface to ease the stretching of the carrier and to prevent tearing of the stretchable carrier.

The present invention further provides a collection of parts for the making of the stretcher frame, whereby a choice is made from stretcher bars, keys, corner pieces, extension elements, reinforcement elements, coupling elements and combinations of these.

BRIEF DESCRIPTION OF THE DRAWINGS

Subsequently, the present invention will be explained on the basis of the attached drawings, in which the following shall represent.

DETAILED DESCRIPTION OF THE INVENTION

Figure 1:
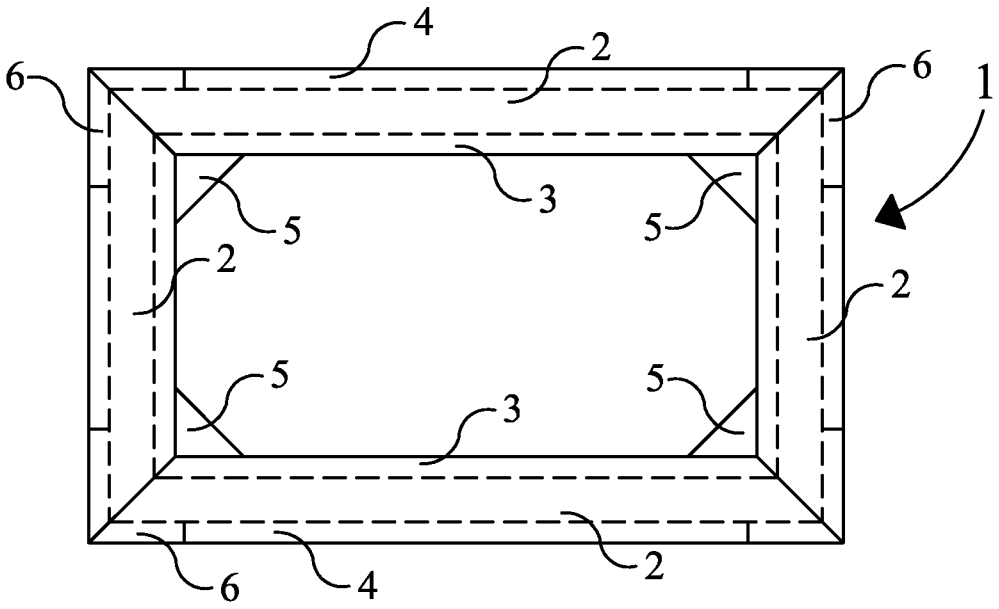
FIG. 1: a diagram of a view from above of a stretcher frame according to the invention.

The current invention concerns a stretcher frame for stretching a carrier, which could be both a length of canvas, linen or printed synthetic material. Such a stretcher frame, when adjustable, is also known as a wedge frame. FIG. 1 shows such a stretcher frame indicated as a whole by the number 1. The stretcher frame consists of four stretcher bars 2, that have each been cut off from a wooden profile with a mitred end. Instead of wood another wood-like material such as MDF or plywood may be used, but it is also possible that synthetic materials or aluminium is used. As a result of the mitring the four stretcher bars form a rectangle when they are connected at their mitred surfaces as is customary. Other shapes however are not excluded. According to the invention, the four stretcher bars 2 are each provided with an inside groove 3 on the inside surface, as can be clearly seen from FIG. 2. Furthermore the four stretcher bars 2 have all been provided with an outside groove 4 on their outside surface.

Figure 4:
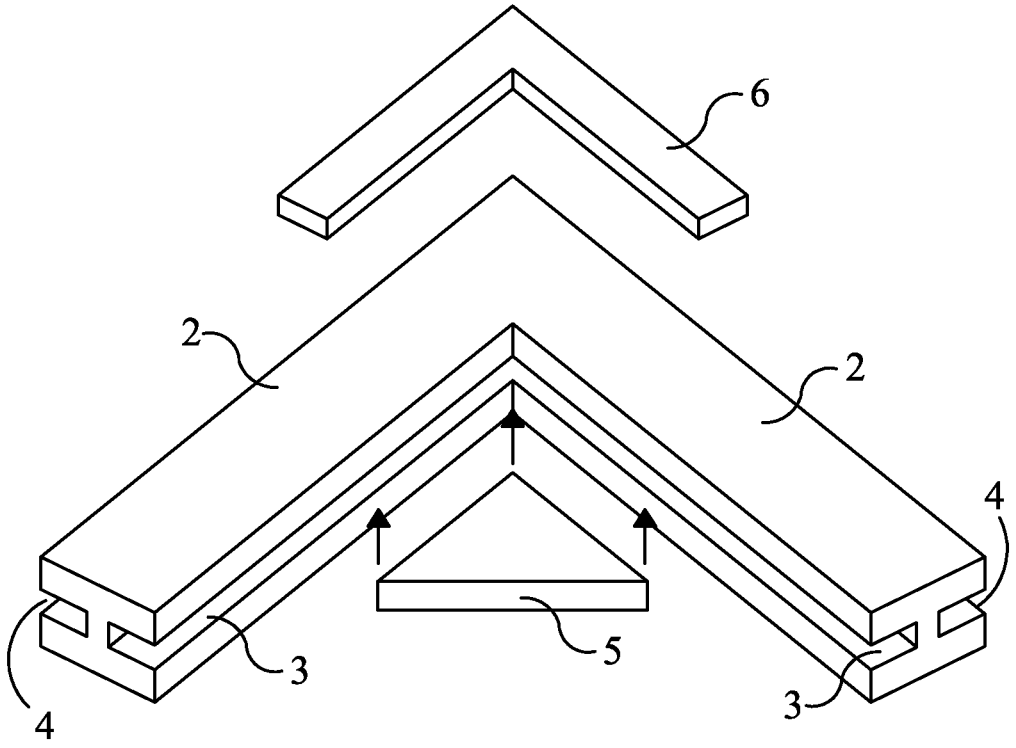
FIG. 4: a diagram perspective view of the stretcher frame shown in FIGS. 1 and 2.

At the corners, where the stretcher bars 2 meet, mainly triangular keys 5 have been placed in the inside groove 3 of the stretcher bars 2. This situation is shown in FIG. 4. The thickness of these keys 5 is such that the keys 5 are jammed inside the inside grooves 3. The keys have the shape of a trapezium whereby the top angle is slightly larger than 90°, in fact about 98°. The two other angles of the triangle are about 41°. As a result of the obtuse angle at the top it is possible to slightly move the angle between the stretcher bars 2 connected by the said key 5 whilst still keeping them connected. The keys are preferably made of an impact-resistant wood product such as plywood or MDF; after all the keys are mostly wedged into place with blows of a hammer, so that they should be capable of withstanding these blows.

To further strengthen the joint between the two stretcher bars 2 meeting in the corner, corner pieces 6 have been inserted, again at the corners, in the outside grooves 4. These corner pieces 6 are L-shaped, but their shape may also differ if the angle between the stretcher bars 2 deviates from 90°. Here too preferably impact resistant wood-like materials are used. In this application too, a wood-like material has the added advantage of a larger friction coefficient when combined with the wood-like material of the stretcher bars 2.

Figure 2:
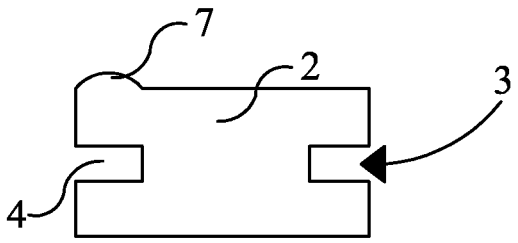
FIG. 2: a cross cut view of the stretcher frame shown in FIG. 1.

FIG. 2 shows a cross cut view of such a stretcher bar 2. Hereby it is notable that on the front surface that is pointed towards the carrier to be stretched, the stretcher bar has been provided with a round profile 7 towards the edge of the outside surface. This round profile creates a distance between the carrier, such as a painting canvas, and the actual stretcher frame, thereby preventing the inside edges of the stretcher frame coming into contact with the carrier which would make them visible.

Figure 3:
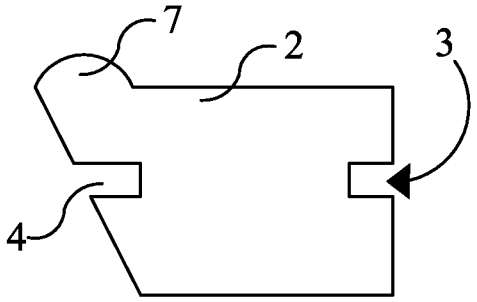
FIG. 3: a cross cut view of a first variant of the stretcher frame shown in FIG. 2.

FIG. 3 shows a variant of the stretcher bar show in FIG. 2. This stretcher bar 12 has a larger thickness, which makes it suitable for larger stretcher frames and larger carriers. Because such a thick stretcher frame, if it would not be viewed straight at its main surface, would be rather conspicuous, the outside surface of the stretcher bar 12 has been bevelled to the inside.

Figure 5:
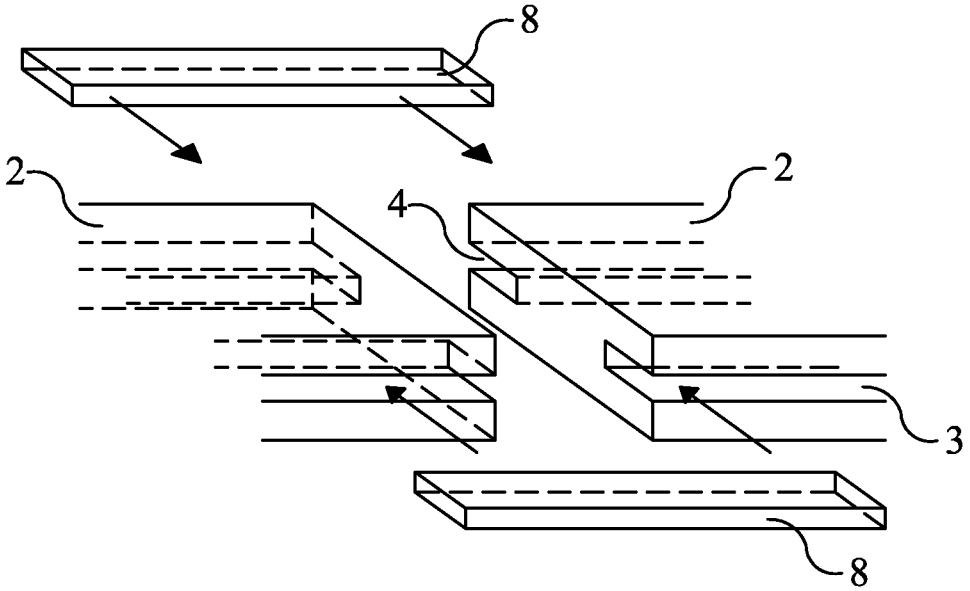
FIG. 5: a diagram perspective view of a second variant of the stretcher frame shown in FIGS. 1, 2 and 4.

When constructing the stretcher frames the stretcher bars are sawn off from profile material. In order to be able to make use of any remainder pieces the profile sections can be lengthened by applying extension elements 8, that can be set into the outside groove and the inside groove of the stretcher bars and fixed there by using adhesive, as is shown in FIG. 5. For the construction in FIG. 5 the joint surface between the sections of stretcher bar stretches perpendicular to the length of the stretcher bar sections. The joint between both stretcher bar sections would become stronger, however, if the interface surface between both sections would stretch out at an angle because this would increase the contact surface.

Figure 6:
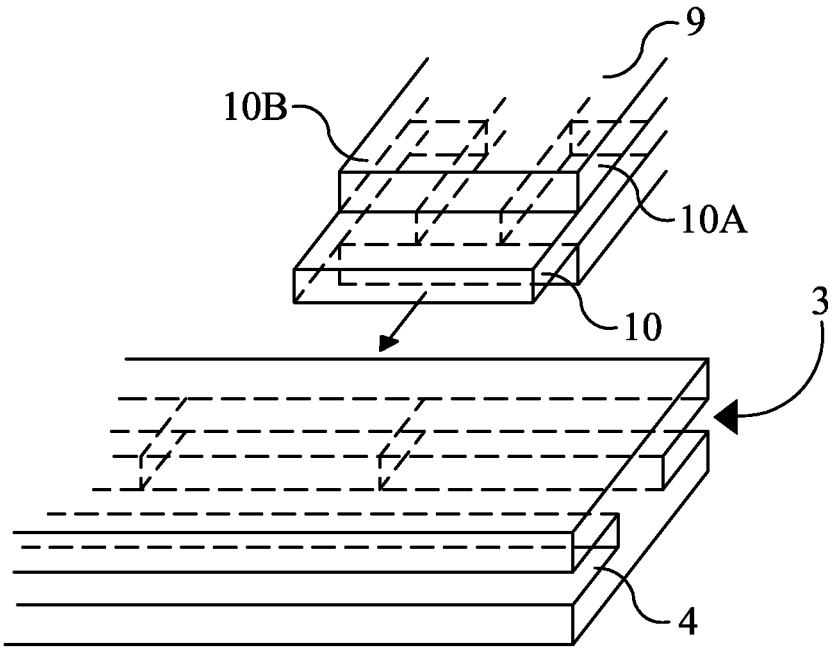
FIG. 6: a diagram perspective detail view of a third variant of the stretcher frame shown in FIGS. 1, 2 and 4.
Figure 7:
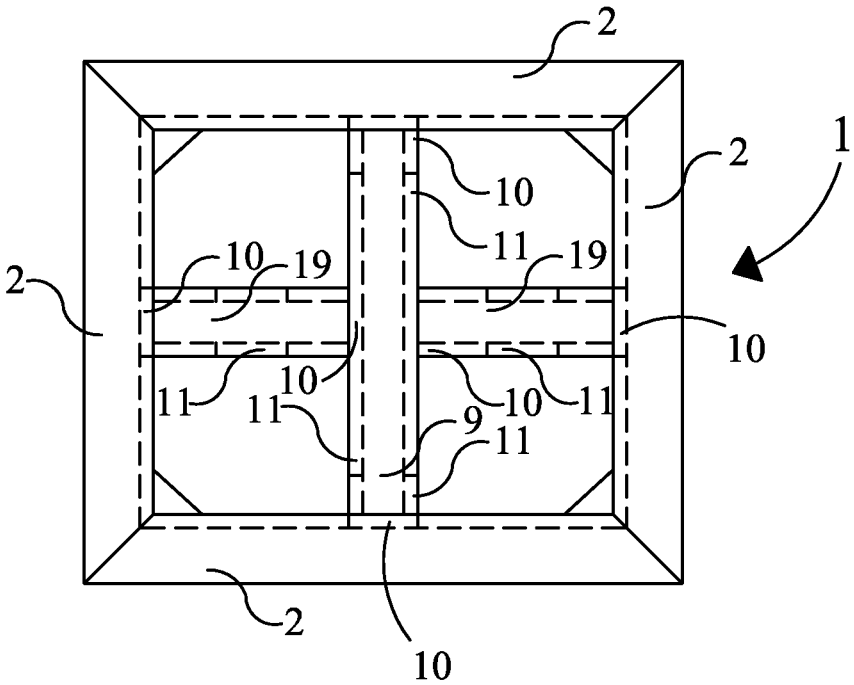
FIG. 7: a view from above of the variant shown in FIG. 6.

Apart from applying a thicker and stronger stretcher frame it is also possible to strengthen the stretcher frame by using a reinforcement element 9 that connects two opposing stretcher bars 2. FIG. 7 shows such a configuration. Furthermore two extra reinforcement elements 19 are shown here that each stretch between a reinforcement element 9 and a stretcher bar 2. The manner in which the reinforcement elements 9 are connected to the stretcher bars is shown in FIG. 6. At the crosscut end of a reinforcement element 9 a U-shaped coupling element 10 has been fitted of which the legs 10*a* stretch out into the grooves 11 that are provided for in the reinforcement element 9. The coupling piece 10*b* of the coupling element 10 sticks out from the reinforcement element 9 and, when placing the reinforcement element 9 in the stretcher frame, coupling piece 10 stretches out into the inside groove 3 of the stretcher bar 2. It speaks for itself that the other side of the reinforcement element 9 has a similar construction. Thereby the coupling element 10 is preferably glued to the reinforcement element 9 with adhesive. When the carrier has to be stretched on the stretcher frame at a later stage, then it is necessary not to join the coupling elements to the stretcher bars with glue.

Figure 6A:
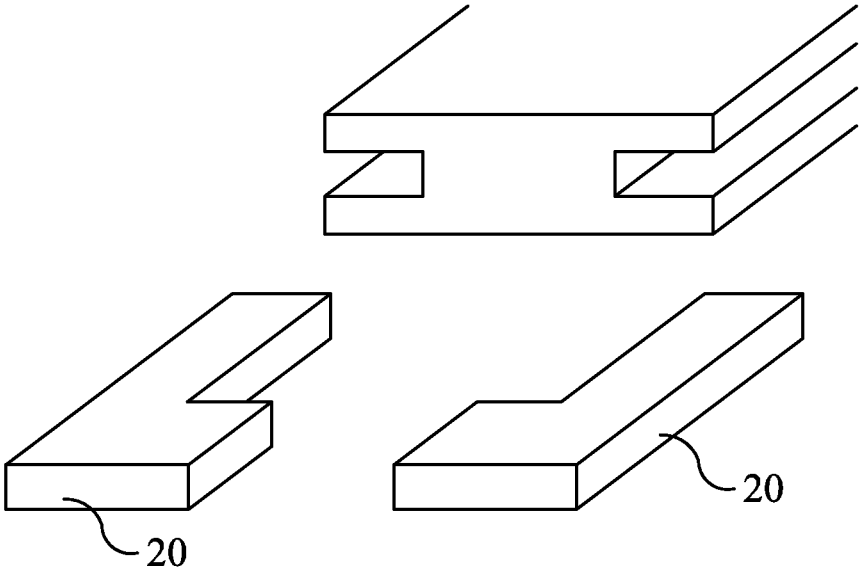
FIG. 6A: a detailed view corresponding to FIG. 6 of a specific construction of the variant shown in the figure.

FIG. 6A shows a situation whereby the U-shaped coupling element 10 has been replaced by two L-shaped coupling elements 20. This construction makes it possible for these dimensions to make use of the corner pieces 9 for the coupling elements 20.

From FIG. 7 it further appears that between the reinforcement element 9 and the parallel stretching stretcher bars 2 extra reinforcement elements are inserted that are also connected by means of coupling elements. Hereby use is made of the grooves present in the reinforcement elements of which the dimensions should preferably correspond to the grooves in the stretcher bars. This further offers the possibility to use the same profiles for the reinforcement elements as for the stretcher frames, although if the profile was provided with a round profile 7, this would have to be removed before the profile could be used as a reinforcement element.

It will be clear that numerous variations can be added to the above constructions within the framework of the claims and that the measures of different constructions can be combined in many ways.

The invention claimed is:

1. A Stretcher frame for a stretchable carrier whereby the stretcher frame comprises: at least three longitudinal stretcher bars stretching along a straight line between corners, whereby the stretcher bars are divided in a corner by surfaces that stretch out along a bisecting line of an angle that is enclosed between a centre line of the stretcher bars meeting in the corner; and a triangular key set in the corner that is connected to both stretcher bars that meet in the said corner by means of a friction caused by the clamping between the stretcher bars and the key, whereby a top angle of the key is aimed at the corner, wherein that the key has a top angle that is larger than the angle that is enclosed by the centre lines of the stretcher bars meeting in the corner, wherein a groove is provided across an entire length of an outside side edge of the stretcher frame and at least one corner piece has been jammed into an outside groove of the stretcher bars meeting in the corner, wherein a top surface of the outside side edge has a rounded profile.

2. The Stretcher frame according to claim 1, wherein that the stretcher frame has a rectangular structure, the stretcher frame has four stretcher bars and a plurality of keys, wherein at least one of the keys has an obtuse angle.

3. The Stretcher frame according to claim 2, wherein at least one key of the plurality of keys has been fitted to each of the corners.

4. The Stretcher frame according to claim 1, wherein an inside edge of the stretcher frame has been provided with a groove and the key is jammed into the inside groove of the stretcher bar.

5. The Stretcher frame according to claim 4, wherein that the depth of the inside groove is at least twice as deep as the width of the inside groove.

6. The Stretcher frame according to claim 2, wherein the keys have been made of a wood product.

7. The Stretcher frame according to claim 1, wherein a corner piece has been fitted at each of the corners of the stretcher bars.

8. The Stretcher frame according to claim 1, wherein, at least one of the stretcher bars is made up of at least two stretcher bar sections, the stretcher bar sections are provided with a groove on an inside and outside surface starting at the joint and that the stretcher bar sections meeting at a joint have been connected by two extension elements that stretch out in a groove on the inside surface, and a groove on the outside surface.

9. The Stretcher frame according to claim 8, wherein the extension elements have been made of wood.

10. The Stretcher frame according to claim 2, wherein the stretcher frame has been provided with a reinforcement element that stretches between two parallel stretcher bars, which is located perpendicular to the parallel stretcher bars and that the reinforcement element has been connected inside the groove on the inside of the parallel stretcher bars with coupling elements.

11. The Stretcher frame according to claim 10, wherein the coupling elements have at least a first part that runs along the inside of the parallel stretcher bars and at least a second part that runs along a groove that has been made on one of the sides of the reinforcement element.

12. The Stretcher frame according to claim 11, wherein the coupling elements have an L-shaped configuration, of which one leg runs on the inside groove of the parallel stretcher bars and the other leg runs in the groove provided on one of the sides of the reinforcement element.

13. The Stretcher frame according to claim 11, wherein that the coupling elements have a U-shaped configuration, with at least two legs configured to run in the groove provided on both sides of the reinforcement element and a connecting section is placed inside the groove on the inside of the stretcher bars.

14. The Stretcher frame according to claim 11, wherein a thickness and a width of the profile of the reinforcement element generally correspond to the thickness and the width of the profile of the stretcher bars.

15. The Stretcher frame according to claim 1, wherein the stretcher bars are provided with a raised profile running along a length and a front edge of their outside surfaces.

16. The Stretcher frame according to claim 15, wherein the stretcher bars are beveled on their outside surface from front to back.

* * * * *